US006588225B1

(12) United States Patent
Hodgson et al.

(10) Patent No.: US 6,588,225 B1
(45) Date of Patent: Jul. 8, 2003

(54) WATER MAKING APPARATUS

(75) Inventors: Thomas Clarence Hodgson, Lynfield (NZ); Anton Rudolf Mikulicic, Titirangi (NZ)

(73) Assignee: Watermaster Technologies Limited, Auckland (NZ)

( * ) Notice: Subject to any disclaimer, the term of this patent is extended or adjusted under 35 U.S.C. 154(b) by 0 days.

(21) Appl. No.: 09/623,159

(22) PCT Filed: Feb. 25, 1999

(86) PCT No.: PCT/NZ99/00024

§ 371 (c)(1),
(2), (4) Date: Oct. 16, 2000

(87) PCT Pub. No.: WO99/43990

PCT Pub. Date: Sep. 2, 1999

(51) Int. Cl.[7] ..... F25D 21/14
(52) U.S. Cl. ..... 62/285; 62/93; 62/291
(58) Field of Search ..... 62/93, 291, 285

(56) References Cited

U.S. PATENT DOCUMENTS 1,931,347 A 10/1933 Gay ..... 62/124
3,803,860 A * 4/1974 Nagashima et al. ..... 62/58
3,816,266 A * 6/1974 Izumi et al. ..... 203/11
4,321,802 A * 3/1982 Sakamoto ..... 62/330
5,106,512 A * 4/1992 Reidy ..... 210/744
5,149,446 A * 9/1992 Reidy ..... 210/744
5,203,989 A * 4/1993 Reidy ..... 210/137
5,553,459 A * 9/1996 Harrison ..... 62/93

FOREIGN PATENT DOCUMENTS

EP 0597716 5/1994

* cited by examiner

*Primary Examiner*—William C. Doerrler
*Assistant Examiner*—Mark Shulman
(74) *Attorney, Agent, or Firm*—Andrus, Sceales, Starke & Sawall, LLP

(57) ABSTRACT

This invention is directed towards apparatus for the production of water from air, and in particular for the production of drinking water. The apparatus includes an air intake device adapted to move air into the apparatus, an evaporator adapted to freeze the water contained in the air issuing from the air intake device and defrosting means adapted to defrost the water frozen by the adapter; the volume of air passing over the frosting surface of the evaporator; evaporator being controlled by either the air intake device or the evaporator. In an alternative form the apparatus may include an air intake device adapted to move air into the apparatus, an air temperature controller to control the temperature of the air entering the apparatus, an evaporator adapted to freeze water contained in the air issuing from the temperature controller and a defroster adapted to defrost the water frozen by the evaporator. The apparatus of the invention may be employed for removing sufficient quantities of water from the air for general household use, as well as enabling the heating of this water if desired.

14 Claims, 4 Drawing Sheets

WATER MAKING APPARATUS

TECHNICAL FIELD

Figure 1:
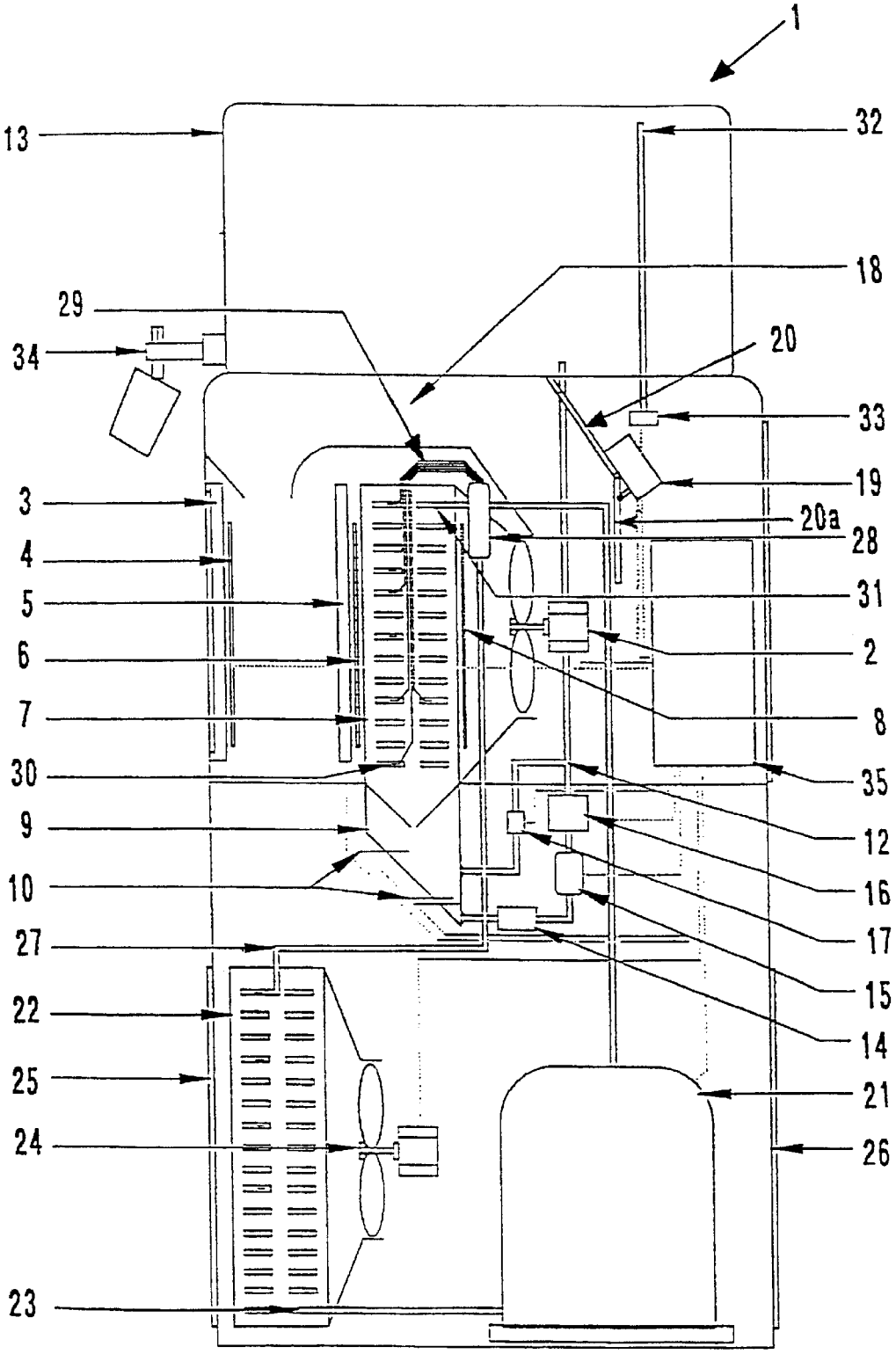

The invention is directed to an apparatus for the production of water from air. In particular, the invention is directed to an apparatus for the production of drinking water.

BACKGROUND ART

There are many known systems for removing water from the air. These tend to be devices which are commonly called "dehumidifiers". For example, New Zealand Patent No. 270431 to EBAC Limited, entitled "dehumidifiers" is a case in point. This New Zealand patent discloses a device for extracting moisture from the air in a building. The invention to which this New Zealand patent is directed is described as being a dehumidifier in which a refrigerant is circulated by a compressor through an evaporator, which becomes cold, and a condenser, which becomes warm, and air is passed over the evaporator so that any moisture in the air condenses on the evaporator, following which the air passes over the condenser to be warmed before leaving the dehumidifier. If the water that collects on the evaporator freezes, the dehumidifier periodically enters a defrost mode which allows the ice to melt. Therefore, creation of ice on the evaporator is a problem of operating a dehumidifier of this type. Such dehumidifiers are not directed to the production of drinking water but are rather directed to the removal of moisture from the air.

Devices which are directed specifically to the production of the water are also known. One device called the "WATERMAKER" is manufactured by Electric and Gas Technology, Inc. of Dallas, Tex., U.S.A. This device operates by drawing room air into the device through a disposable air filter. This filtered air then passes through cooling coils that are made of a refrigerator alloy coated with polyurethane. These coils are kept at a temperature of approximately 39° F. Some of the moisture in the filtered air will condense on these coils resulting in droplets of distilled water. The water droplets run down the coils and collect in a funnel that feeds the water into a holding tank. This tank is held inside a cooled box which has its own cooling system and is fully insulated. There are a number of difficulties with this technology. The apparatus requires humid air in the surrounding atmosphere. Once the air has been dehumidified, the apparatus stops. In addition, once ice forms on the coils, the melting of this ice is achieved by using hot gas from the condenser in a manner which is inefficient.

OBJECT OF THE INVENTION

It is an object of the invention to provide an apparatus which meets some of the difficulties of prior art devices or at least to provide the public with a useful choice.

SUMMARY OF THE INVENTION

The invention in the first aspect is an apparatus for the production of water from air wherein the apparatus includes:

(a) an air intake device adapted to move air into the apparatus;

(b) an evaporator adapted to freeze the water contained in the air issuing from the air intake device; and (c) defrosting means adapted to defrost the water frozen by the evaporator;

and wherein the volume of air passing over the frosting surface of the evaporator is controlled by either the air intake device or the evaporator.

Preferably the air intake device is adapted to move a variable volume of air over the evaporator and the evaporator is of constant frosting area.

Preferably the air intake device is adapted to move a constant volume of air over the evaporator and the evaporator has a variable frosting area.

Preferably, the apparatus further includes a reservoir to collect the water created from defrosting the evaporator.

Preferably, the apparatus further comprises an air filter situated to filter the air moving into apparatus.

Preferably, the filter is a washable or a disposable filter.

Preferably, the filter is 200 micron washable filter.

Preferably, the defrosting means includes a defrost sensor to detect when a predetermined amount of ice or frost has formed in the evaporator.

Preferably, the air intake device is a fan adapted to draw air into the apparatus through the evaporator.

Preferably, the air intake device is a blower adapted to force air into the apparatus.

Preferably, the evaporator may include one or more helically corrugated conduits as described and claimed in International Patent Application Number PCT/NZ93/00087.

In an alternative form, the evaporator may include a plurality of interconnected coils.

Preferably, the evaporator may include a plurality of fins having at least 4 fins per 25 millimeters of coil. More preferably, the evaporator includes at least 6 fins per 25 millimeters of coil.

Preferably, the evaporator is cooled using a compressor and condenser system.

Preferably, the condenser may include one or more helically corrugated conduits as described and claimed in PCT/NZ93/00087.

Preferably, the compressor and condenser system includes a compressor, a condenser, and a plurality of capillary tubes, wherein the evaporator includes a plurality of interconnected coils and the capillary tubes feed directly into the evaporator coils, and wherein the compressor provides a gaseous refrigerant under pressure into the condenser, the cooled refrigerant exiting the condenser as a liquid under pressure and being directed to the capillary tubes via a high pressure feed, the capillary tubes then passing the refrigerant in a gaseous form into the evaporator from which the refrigerant exits as a gas under low pressure and returns via a low pressure feed to the compressor, and wherein the system is a closed system.

In one preferred form of apparatus of the present invention the compressor and condenser system may further include a compressor/evaporator line adapted, under predetermined conditions, to enable hot gas refrigerant from the compressor to enter the coils of the evaporator to melt any ice or frost formed on the evaporator.

Preferably, a solenoid valve may be provided in the secondary line, said valve controllable by the defrost sensor.

Preferably, the plurality of capillary tubes exits from a filter situated between the capillary tubes and the high pressure feed from the condenser.

Preferably, at least one of the capillary tubes enters the evaporator coils at, or adjacent to, the base of the evaporator.

Preferably, the capillary tubes enter the evaporator coils at a variety of positions about the evaporator.

Preferably a TX valve may be used in lieu of the capillary tubes.

Preferably, the gaseous refrigerant exits the evaporator from the top portion of the evaporator.

Preferably, condenser is cooled by air drawn across the condenser by a suction fan situated inside the apparatus or blown across the condenser by a blower situated outside the apparatus.

Preferably, the defrosting means, the air intake device and the temperature of the evaporator are controlled via a single central processing unit.

Preferably, the apparatus includes two water reservoirs, the first being a temporary reservoir being used for temporary storage of water following melting of the ice/frost from the evaporator, the second being a permanent reservoir into which the water from the temporary reservoir is moved for longer term storage, one permanent reservoir can be used.

Preferably, the temporary reservoir contains water level sensors adapted to trigger a pump to move the water contained in the temporary reservoir to the permanent reservoir.

Preferably, the apparatus further includes at least one disinfecting or filtration device adapted to further purify the water. Preferably, the filter is an ozonic filter or an activated charcoal filter. Preferably, the disinfector is an electrical disinfector.

Preferably, the filtration and/or disinfecting device is situated between the temporary reservoir and the permanent reservoir, when one permanent reservoir is used the filtration/disinfecting device may be positioned before the reservoir, or, after the reservoir and before outlet water tap.

In a further preferred form the apparatus of the present invention may further include a heat exchanger connectable to the outlet from the compressor.

Preferably, the heat exchanger may include a conduit within a water tank.

Preferably, said conduit is connectable to the outlet of the compressor via a solenoid valve. Preferably, the solenoid valve may be controlled by the central processing unit.

Preferably, an outlet from the conduit returns to the outlet from the compressor.

Preferably the apparatus further includes an air temperature controller to control the temperature of the air entering the apparatus.

The invention in a second aspect is an apparatus for the production of water from air wherein the apparatus includes:

(a) an air intake device adapted to move air into the apparatus;

(b) an air temperature controller which controls the temperature of the air entering the apparatus;

(c) an evaporator adapted to freeze water contained in the air issuing from the temperature controller; and (d) a defroster, adapted to defrost the water frozen by the evaporator.

Preferably, the apparatus further includes a reservoir to collect the water created from defrosting the evaporator.

Preferably, the apparatus further comprises an air filter situated to filter the air moving into apparatus.

Preferably, the filter is a washable or a disposable filter.

Preferably, the filter is 200 micron washable filter.

Preferably, the defroster includes a defrost sensor to detect when a predetermined amount of ice or frost has formed in the evaporator.

Preferably, the defroster is a combination of a warming of the evaporator and an increase in the temperature of the air issuing from the temperature controller.

Preferably, the air intake device is a fan adapted to draw air into the apparatus via the air temperature controller and through the evaporator.

Preferably, the air intake device is a blower adapted to force air into the apparatus.

Preferably, the evaporator includes a plurality of interconnected coils.

Preferably, the evaporator includes a plurality of fins having at least 4 fins per 25 millimeters of coil. More preferably, the evaporator includes at least 6 fins per 25 millimeters of coil.

Preferably, the evaporator is cooled using a compressor and condenser system.

Preferably, the air temperature controller includes a first air temperature sensor situated at, or adjacent to, the entrance of the air intake device; and an air heater/cooler positioned between the first air temperature sensor and the evaporator.

Preferably, the air temperature controller includes a second air temperature sensor positioned between the air heater/cooler and the evaporator.

Preferably, the air temperature controller includes a third air temperature sensor positioned such that the evaporator is interposed between the second air temperature sensor and the third air temperature sensor.

Preferably, the heater/cooler in the air temperature controller includes a combination of an air heater and a cold air flow, the cold air flow being directed between the first air temperature sensor and the air heater.

Preferably, the cold airflow is directed from the area adjacent the third air temperature sensor and is channelled to the area between the first air temperature sensor and the air heater via a ducting system which is constrictable in response to cold airflow requirements.

Preferably, the temperature of the airflow from the temperature controller is between about 25° C. and about 36° C., more preferably between about 29° C. and about 32° C.

Preferably, the defroster, the air temperature controller, the air intake device and the temperature of the evaporator are controlled via a single central processing unit.

Figure 4:
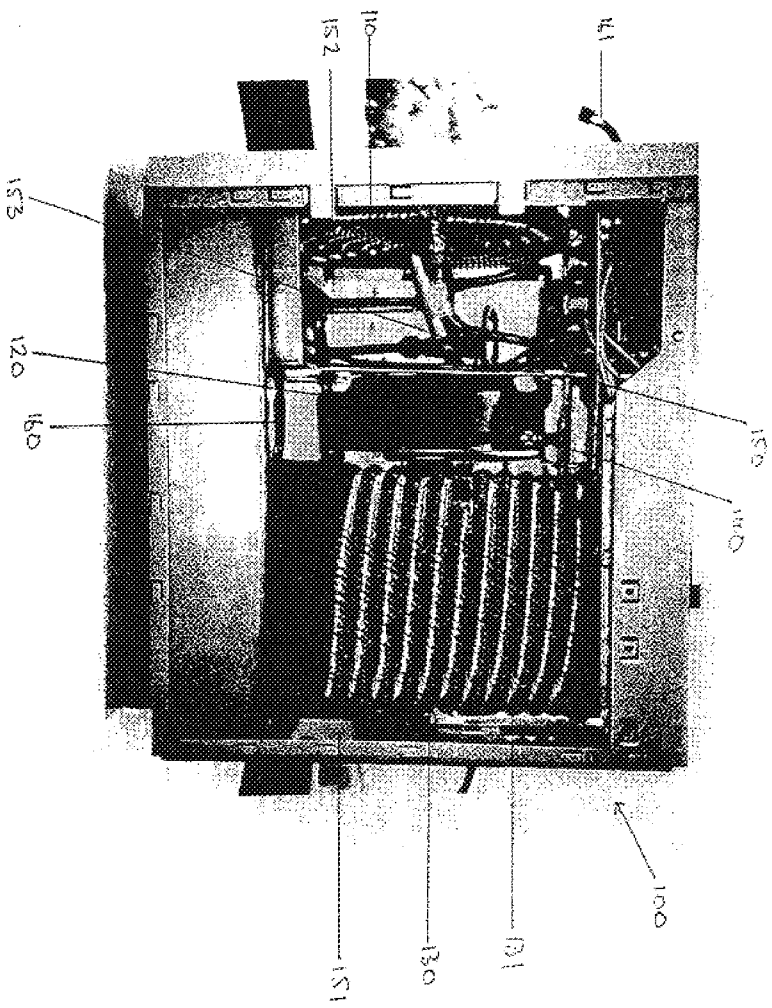

According to a third aspect of the present invention there is provided apparatus for the production of water from air substantially as herein described and with particular reference to FIG. 4.

The invention, in a fourth aspect, may be seen to be a closed loop refrigerant system which includes a compressor, a condenser, an evaporator and a plurality of capillary tubes; wherein the evaporator includes a plurality of interconnecting coils and the capillary tubes feed directly into the evaporator coils and wherein the refrigerant feed from the compressor to the evaporator via the condenser is a high pressure feed, and refrigerant feed from the evaporator to the compressor is a low pressure feed, and wherein the high pressure feed from the condenser to the evaporator includes a single feed exiting the condenser and the plurality of capillary tubes entering the evaporator, the single feed providing the refrigerant to the capillary tubes as a liquid and the capillary tubes providing the refrigerant to the evaporator as a gas.

Preferably, the single feed exiting the condenser enters a refrigerant filter from which the plurality of feeds exit.

Preferably, the plurality of capillary tubes includes between about 3 and about 10 capillary tubes, more preferably about 5 capillary tubes.

Preferably, at least one of the capillary tubes provides gaseous refrigerant into the evaporator tubes at, or adjacent to, the base of the evaporator.

Preferably, the capillary tubes enter the evaporator coils at variety of positions in the evaporator.

Preferably, the gaseous refrigerant exits the evaporator tubes in the evaporator from the top portion of the evaporator.

Preferably a TX valve may be used in lieu of the capillary tubes.

Preferably, the condenser is cooled by air drawn across the condenser by a suction fan situated inside the apparatus or blown across the condenser by a blower situated outside the apparatus.

Other aspects of the present invention may become apparent from the following description which is given by way of example only and with reference to the accompanying drawings.

DRAWINGS

Figure 2:
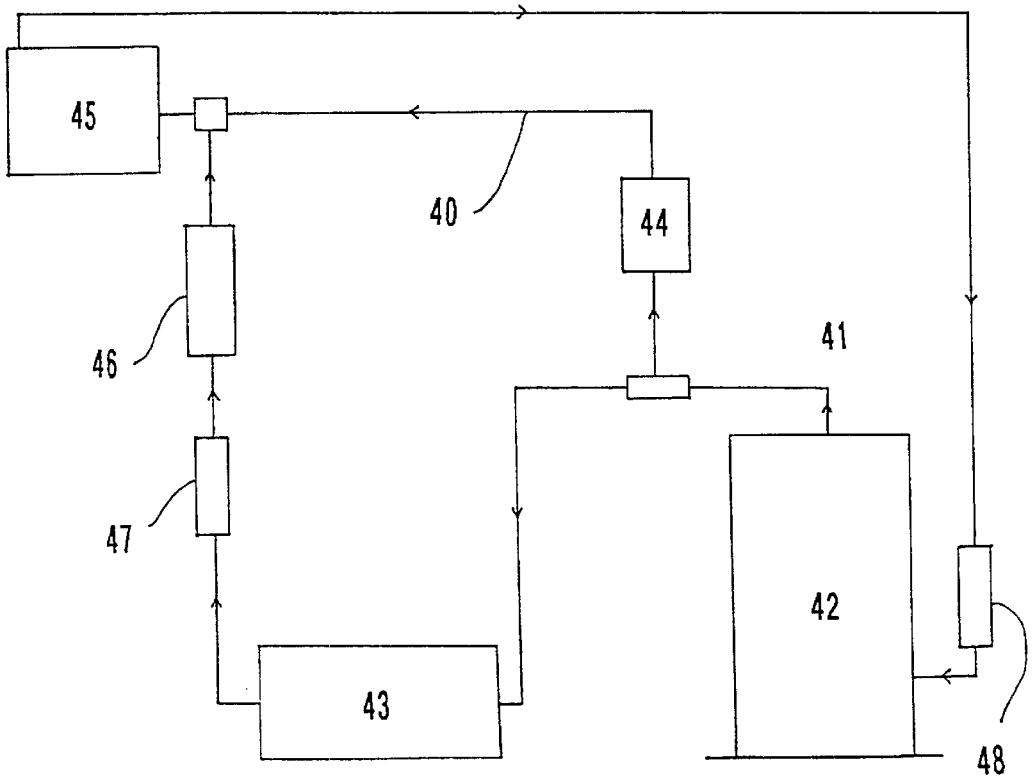
Figure 3:
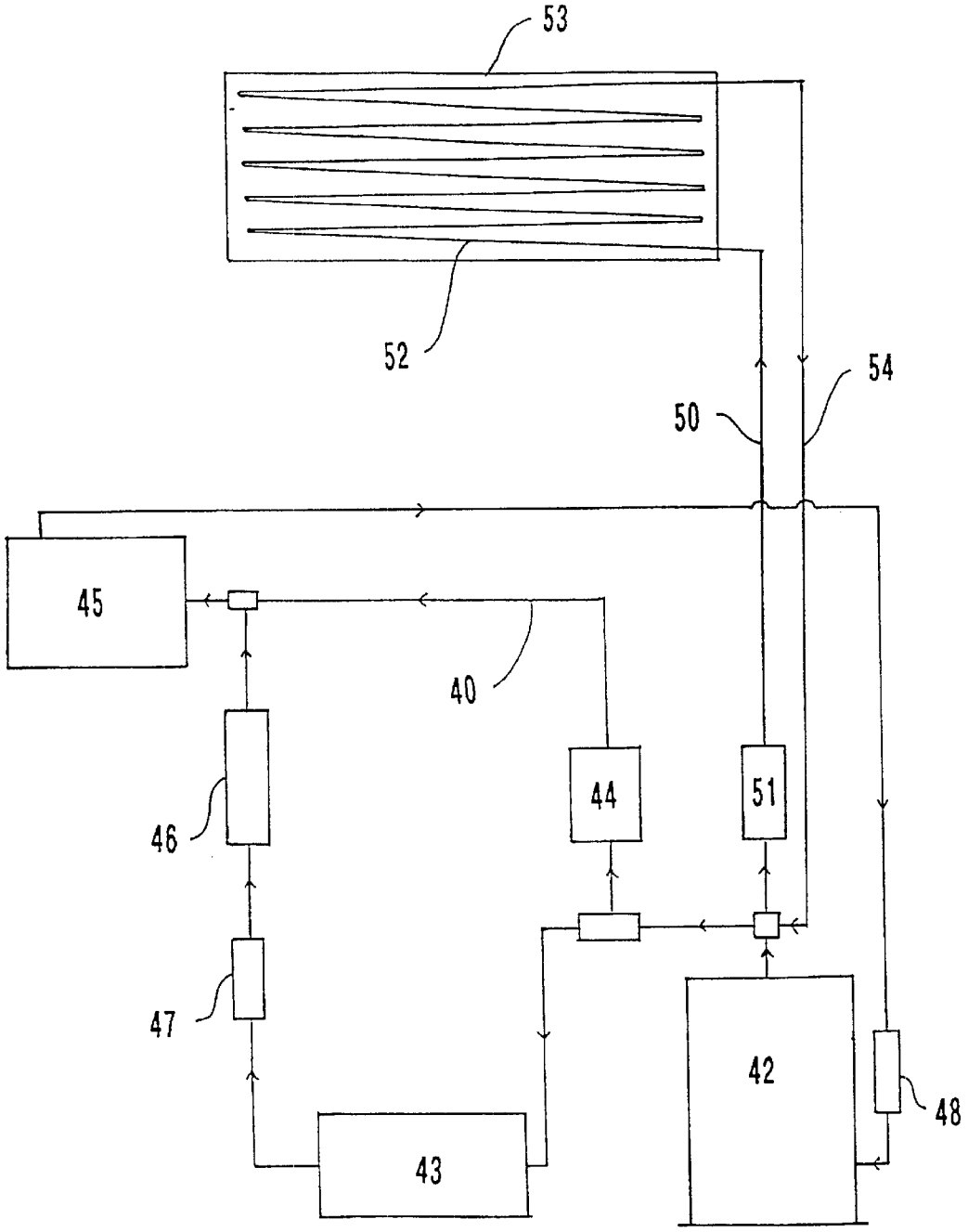

The invention will be described with reference to preferred forms of the invention as shown in the attached Figures. In the Figures:

FIG. 1: shows a cutaway schematic representation of a watermaking apparatus;

FIG. 2: shows a schematic representation of the apparatus incorporating a hot gas de-icing function;

FIG. 3: shows a schematic representation of the apparatus further including a heat exchanger.

FIG. 4: shows a preferred form of the invention.

DETAILED DESCRIPTION OF INVENTION

The invention is directed generally to an apparatus for the production of water from the air. The water could be used for drinking provided suitable filters and other treatment devices are included or could be used for other applications as will be readily apparent to a skilled person.

It has been found that water can be efficiently removed from the air by freezing the water on an evaporator if the temperature of the air crossing the evaporator is held within certain temperature limits. The freezing capacity of the evaporator (based on compressor size/evaporator size) is constant as is the volume of the air crossing the evaporator (i.e. a constant speed fan was preferably used). The volume of the air entering the apparatus could be altered by varying the speed of the fan used, if necessary, in response to the temperature of the air entering the device but this was limited as the air temperature was held within a defined temperature range. The variables are controlled by a central processing unit of known construction. FIGS. 1–3 attached to this application and the following disclosure with reference to FIGS. 1–3 repeats the disclosure of this invention.

With reference to FIG. 1, the apparatus 1 includes a suction fan 2 which draws air from the atmosphere surrounding the apparatus 1 through an air filter screen 3, over a first air temperature sensor 4 and thus into the apparatus 1. The air then passes through an air heater 5, over a second air temperature sensor 6, and then through an evaporator 7. An after cooler air temperature sensor 8 may be situated between the evaporator 7 and the suction fan 2. The evaporator 7 is connected to a temporary water reservoir 9. This temporary water reservoir 9 includes water level sensors 10 and is connected via a water feed 12 to a main water reservoir 13. The water feed 12 includes a water filter 14, a water pump 15 and a water disinfector 16. The water feed 12 may also include a recycling option via recycling return valve 17 to the temporary water reservoir 9.

The apparatus 1 also includes a cold air duct 18 which leads to the space between the first air temperature sensor 4 and the air heater 5. This cold air duct 18 can be opened or closed via the action of deflector plate actuator 19 on the air deflector plates 20, 20*a*. As shown in FIG. 1, the air deflector plates 20, 20*a* are in a position which would allow air to flow through the duct 18. Air is drawn from the surrounding atmosphere via the suction fan 2 over the evaporator 7 and a portion of this air, now cooled on the evaporator 7, is deflected into duct 18 via deflector plate 20*a*. When deflector plates 20 and 20*a* are in the closed position via the action of deflector plate actuator 19, deflector plate 20 closes the air duct 18 and deflector plate 20*a* is raised out of the path of the air being drawn through the apparatus by suction fan 2. The temperature of the cool air passing through duct 18 is determined by after cooler air temperature sensor 8 positioned between evaporator 7 and fan 2. In response to air temperature requirements and the temperature of the cool air exiting the evaporator 7, the duct 18 may be constricted as needed by deflector plate 20. The sensors 4, 6, 8 all input information into central processing unit 35 which processes this information as will be known in the art.

The apparatus 1 also includes a system for circulating a refrigerant through the evaporator 7. The system shown in FIG. 1 in apparatus 1 is a closed system including a compressor 21 which is attached to a condenser 22 via a high pressure feed 23. A suction fan 24 draws air from the atmosphere surrounding the apparatus 1 through a mesh screen 25 over the condenser 22. The air then continues through the apparatus 1 and exits via the mesh screen 26.

The condenser 22 is then connected to evaporator 7 via a high pressure refrigerant feed 27, a refrigerant filter 28, and capillary tubes 29. As shown in the preferred embodiment of the invention in FIG. 1, there are five capillary tubes which exit refrigerant filter 28 and feed the refrigerant into the evaporator 7 at a high pressure. The capillary tubes 29 enter the evaporator 7 at a variety of positions, for example at entry 30, and the refrigerant exits from the top of the evaporator 7 via a low pressure refrigerant return 31 to the compressor 21.

As shown in FIG. 1, the apparatus 1 also include a breather and water level sensor 32 in the main water reservoir 13. The breather and water level sensor 32 also includes a breather filter 33. Attached to the main water reservoir 13 is a tap 34 from which water can exit the main water reservoir 13 in a controlled manner.

Apparatus 1 further includes a central processing unit 35 which controls the amount and temperature of the airflow over the evaporator 7, the airflow over the condenser 22, and the temperature of the evaporator 7. The central processing unit 35 also includes a defrost sensor (not shown) which will determine when there has been sufficient ice and frost build up in the evaporator 7 and which, as a result, will determine when the refrigerant will stop flowing into evaporator 7 and when the air temperature flowing across evaporator 7 is maximised via heater 5 to melt the ice/frost on the evaporator 7. The central processing unit 35, in effect, controls the operation of the apparatus 1 in total.

The evaporator 7, in one form, includes a series of coils which comprise between about 30 and about 50 connecting tubes. Preferably, the evaporator 7 will include about 40 connecting tubes. Each tube includes a number of, preferably angled, fins. There may be between four and eight fins arranged over every 20 to 30 millimeters of the connecting tubes in the evaporator 7, and there may be 6 angled fins per 25 millimeters of each tube. The connecting tubes are preferably formed of one millimeter tubing, however, this may be replaced by any suitable form of tubing as will be known in the art. The evaporator 7 may have four layers of this tubing which can be interconnected to allow refrigerant to flow throughout the evaporator 7. The number of layers of tubing may be between about 3 and about 6 as desired. The evaporator may alternatively be formed of a mesh material with openings of between about 3 and 5 millimeters, more preferably 4 millimeters, although any suitable mesh as will be known in the art could be used. In the most preferred form, the mesh openings will be angled from the line of initial airflow entry. A further alternative would be to use angled metal plates at the front of the evaporator with evaporator tubes at the back of the evaporator to cool the plates, thus allowing ice/frost to form in the angled plates.

In an alternative, and preferred form the evaporator 7 may include one or more helically corrugated conduits, the or each conduit as described and claimed in international patent application no. PCT/NZ93/00087, which patent specification is specifically incorporated herein by reference.

Such helically corrugated conduits may also form the coils of the condenser.

The air filter 3 may be of any suitable form. Preferably, the filter is a 200 micron washable filter that may be removed for cleaning as necessary. This filter is not essential to the operation of the apparatus 1 as shown in FIG. 1, as will be readily apparent to a skilled person. The apparatus 1 also includes a water filter 14 and a disinfector 16. These may be of any suitable type, however, electrical charge disinfectors as known in the art will be preferred. Water filters such as ozonic filters and activated charcoal filters for example could be used. As will be readily apparent the filter and disinfector may be omitted if desired.

As can be seen in FIG. 1, two fans 2, 24, are used to suck air into the apparatus 1. The fans are preferably 800 cfm fans, but can be replaced by any suitable device as will be known in the art. The fans may be replaced by air blowers or similar devices for example. The airflow into the apparatus 1 is important to the efficient running of the apparatus. The fan speed is usually run between 280 cfm and 800 cfm depending on the size of the apparatus. It is an optional feature of the apparatus 1 to include an air speed sensor to determine the most efficient airflow. If the airflow is too fast, then ice/frost will not form in the evaporator. If the airflow is too slow, then it will tend to form on the initial parts of the evaporator restricting airflow into the evaporator.

The air temperature sensors 4, 6 and 8, as shown in FIG. 1, are present to ensure that the temperature of the air passing over the evaporator 7 is maintained within a set temperature range. The temperature of the air passing over the evaporator 7 should be between about 25° C. and about 39° C. With a temperature of between about 29° C. and about 32° C. preferred. The air temperature sensors 4, 6, 8 can be of any suitable type and will be connected to the central processing unit 35 in the apparatus 1. In this manner, the central processing unit 35 can control the temperature of the air flowing across the evaporator 7 via the combination of air heater 5 and a cool airflow from a duct 18 via deflector plates 20, 20*a*. The air heater 5 may also be of any suitable form but will preferably contain a mesh having between 3 and about 5 millimeter squares in the mesh. Preferably, the squares will be about 4 millimeter squares. The air heater 5 should be between about 15 and about 25 millimeters in width with a width of about 20 millimeters being preferred. The width and mesh dimensions are not essential elements of the invention and are simply preferments as this will allow air particles to be evenly heated when passing through the heater. The dimensions of the air heater will vary with the size of the apparatus 1 as will be apparent to a skilled person. There are, however, a variety of methods by which this can be achieved and the technique of controlling the air temperature via the heater 5 and the cool airflow via duct 18 may be replaced by a variety of other methods. A single heater/cooler unit in the position of the heater 5 (as shown in FIG. 1) would suffice provided the heater/cooler unit could maintain the air temperature within the temperature band described previously.

In use, and with reference to apparatus 1 as shown in FIG. 1, it is the combination of airflow through the evaporator 7, the temperature of that air, and the dimensions of the fins and tubes in the evaporator 7 which combine to maximise the efficiency of ice and frost formation on the evaporator 7. As mentioned previously, there are a variety of dehumidifier devices which "ice up", thus reducing the efficiency of the devices described. These dehumidifiers have mechanisms designed to remove the ice so formed to ensure the dehumidifier operates efficiently.

The apparatus of the invention shown in FIGS. 1–3 relies upon an efficient production of ice and frost in the evaporator to produce sufficient water to make the apparatus 1 a viable water producer. The system providing the refrigerant to the evaporator provides an evenly balanced refrigerant effect in the evaporator 7, thus ensuring that ice and frost formation is controlled throughout the evaporator 7. If ice forms too rapidly at the front portion of the evaporator nearest to air entry, this will prevent the apparatus operating efficiently by stopping airflow through the evaporator 7 and restricting ice formation to that front portion.

As the warm air enters evaporator 7, the moisture in the warm air is cooled and forms frost and ice in a controlled manner within the evaporator 7. When sufficient frost and ice has formed on the evaporator 7, as determined by a defrost sensor (not shown) in the central processing unit 35, the supply of refrigerant to evaporator 7 is stopped and the heat provided by heater 5 is maximised so the airflow melts the ice and frost in the evaporator which collects as water in temporary water reservoir 9. Alternatively, the temperature of the airflow could remain at normal running temperature. This would, of course, mean that the ice/frost melted less quickly however.

A further embodiment would involve the provision of a hot air blower (not shown) positioned externally to apparatus 1, as shown in FIG. 1, which would blow air at a set temperature through air filter 3 and over the evaporator 7. Provided the temperature of the air from the blower could be adequately controlled, the apparatus 1 as shown in FIG. 1 would then have the option of excluding all, or some of, the temperature sensors 4, 6 and 8, the cooling combination of deflector plates 20, 20*a* and duct 18, as well as the air heater 5 and suction fan 2. To use the terminology used previously herein, the air blower could then be part of the "air intake device" the "air temperature controller" and the "defroster".

FIGS. 2 and 3 show an alternative or additional means of defrosting or de-icing the evaporator using a hot gas flush.

With reference to FIG. 2, the electrical heating system described above may be replaced by the inclusion of a secondary line 40 interconnected with the line 41 between a compressor 42 and condenser 43. A valve 44, such as a solenoid valve, is included to control the flow of refrigerant, which at this stage is in the form of a hot gas, through the secondary line 40 to the evaporator 45. There may also be included a dryer 47 and pressure valve 46 between the condenser 43 and evaporator 45; and a filter 48 between the evaporator 45 and compressor 42. With this system very rapid defrosting or de-icing can occur without having to stop the compressor.

It will be appreciated by those skilled in the art that this type of compressor/condenser system enabling a hot gas flush of the evaporator could be used in any air conditioning plant, existing dehumidifiers and larger water making machinery.

Following collection of water in the temporary reservoir 9, the water passes through filter 14, pump 15 and disinfector 16. Once sufficient water has collected in temporary water reservoir 9 as determined by water level sensors 10 which communicate with the central processing unit 35, pump 15 is actuated to move the water from temporary water reservoir 9 through filter 14 and disinfector 16 to the main water reservoir 13. It will be readily apparent that devices 14, 15, 16 are optional. Filters, such as activated carbon and other standard filtration devices, as well as the disinfector for removing microbiological organisms which may be present would only be required if the water being provided is required for human, or perhaps animal, consumption. The pump 15 could be dispensed with and a simple gravity feed to an external reservoir could be provided if desired. Further, the apparatus would readily be adapted to simply produce water which was not stored in the apparatus but rather exited the apparatus via a simple gravity feed to be used immediately. It is preferred, however, to include at least a temporary reservoir, as indicated at 9 in FIG. 1. Pump 15 can, as will be readily apparent, be of any suitable form as will be known in the art.

The preferred system for providing a refrigerant to the evaporator 7 is a closed system. While the apparatus 1 shown in FIG. 1 discloses a specific compressor/condenser system, it will be readily apparent to a skilled person that this system could be replaced by a variety of standard refrigerant supply systems. The system could, for example, be replaced by known pump technology, compression systems, or rotary pressure devices. While such systems are not preferred systems, it would be well within the ability of a skilled person to use such systems to achieve this end. As will be known to a person skilled in this art, refrigerant supply systems which circulate a liquid refrigerant under pressure and convert that liquid refrigerant to a gas for supply to the evaporator are known. Such systems can be used in the water-making system described herein.

However, the system as described with reference to FIG. 1 has significant advantages in comparison to such systems. Known systems convert the liquid to gas refrigerant by methods such as in-line adjustable valves which supply gaseous refrigerant via a single line usually to the top of evaporator. While suitable for dehumidifier and refrigerator technology, such systems do not provide even cooling over the whole of the evaporator.

In the form of the refrigerant supply system shown in FIG. 1, the refrigerant used in the system can be of any suitable type as will be known in this art. Refrigerants such as chlorofluorocarbons, hydrochlorofluorocarbons, or hydrofluorocarbons could all be used. Any alternative refrigerant suitable for using in such a system may be employed.

The compressor 21 used to supply the refrigerant under pressure the condenser 22 may be any one of a number of types. Any low, medium or high pressure compressors can be used. For example, compressors providing about 100 psi to about 10,000 psi could be used, although this is not intended to be limiting. Compressors such as the 220V–240V compressors supplied by Danfoss of the hermetic or fan cooled types may be used, for example. The condensing unit 22 may again be of any suitable form, as will be known to a skilled person and the 220V fan-cooled condensing units also supplied by Danfoss would be suitable, for example. In addition, 220V–240V compressors and 12V and 24V compressors could also be used if suitable for the particular application. Any of a variety of condensing units may be used and units supplied by Embraco Aspera, Bristol Compressors, Copeland Compressors, to name a few, would also all be suitable.

The refrigerant is supplied in a cooled condition to the evaporator 7 at a variety of positions (e.g. position 30) as shown in FIG. 1. The cooled refrigerant passes through the filter 28 and enters the evaporator 7 via the plurality of capillary tubes 29. In the preferred form, these capillary tubes 29 have a bore of about one millimeter, while the high pressure feed tube 27 has a bore of about six millimeters. In the preferred form, there are five capillary tubes which exit the filter 28 and enter the evaporator 7. The capillary tubes have a reduced bore and are preferably wound in coils similar to a spring. The reduction in bore size coupled with the high pressure of the refrigerant atomises the refrigerant changing the refrigerant from a liquid form (e.g. an oil) to a gas. The now gaseous, refrigerant then seeps directly into the coil system in the evaporator 7 at a variety of positions which allows for an even distribution in the evaporator 7 of the refrigerant gas. The gaseous refrigerant then exits the evaporator coils from the top of the evaporator 7 (as indicated at 31) and passes under low-pressure through feed 31 to compressor 21 where it is pushed into condenser 22 where it is again condensed into a liquid.

The length of the capillary tubes used will depend on the bore diameter of the capillary and the length of the evaporator coils used. If the feed tube from the condenser is between about 8 and about 5 millimeters bore, the bore on the capillaries would be about 1.5 millimeters. If a 12 millimeter bore feed tube from the condenser was used, the capillary bore would be about 2 millimeters. Such requirements would be readily calculable by a skilled person. The length and number of the capillary tubes will be, at least in part, determined by the wattage of the compressor/condenser feeding the tubes. The ability of the preferred refrigerant system to convert a liquid refrigerant into a gaseous form which is then able to be fed directly into the evaporator coils at a variety of positions maximises the efficiency of the system to cool the evaporator evenly. The system's ability to convert the liquid refrigerant to a gas and then directly feed that gas into the evaporator coils at a variety of positions, including at the base of the evaporator, coupled with removal from the top of the evaporator has significant advantages both in terms of cost and in terms of efficient and even cooling of the evaporator. Alternative known methods such as using an adjustable in-line valve (or series of valves) to reduce the bore diameter, thus achieving gas conversion could also be used in the apparatus 1 as has been stated previously. This system using an adjustable valve is used when the pressure is above 3000 psi and would be a far more expensive option than using capillaries as well as having limitations of use with lower pressure systems.

As can clearly be seen in FIG. 1, the capillary tubes 29 enter the evaporator 7 at a variety of positions (e.g. at the base of the evaporator as designated at 30) with removal at the top (as designated generally at 31) designed to maximise the evenness of the cooling effect, and hence ice/frost formation, in the evaporator 7. As opposed to known refrigerant systems, the capillary tubes 29 used enter the connecting tubes in the evaporator 7 directly at a number of positions on the tubes. Once the refrigerant has passed through the evaporator 7, the refrigerant exits near, or at, the top of the evaporator 7. The refrigerant is now at low pressure and exits via the low pressure feed 31 and returns to compressor 21, thus completing the closed loop system provided by the apparatus. It is the ability of this system to evenly cool the evaporator that allows the system to operate most efficiently.

FIG. 3 shows the apparatus of FIG. 2, but further including a heat exchanger. Thus, a further line 50 from the outlet of the compressor 42 may take hot refrigerant gas from the compressor to a coil 52 positioned in a water tank 53. The outlet 54 from the coil 52 then transfers the refrigerant to the outlet from the compressor 41. A valve 51, such as a solenoid valve, may be positioned in the further line 50 to control the transfer of refrigerant through this line. The capacity of the water tank 53 would be dependent on the size of the compressor 51. The coil 52 may be of any size, shape and heat conducting material (such as copper or stainless steel). The pipes of the coil may be slightly flattened to improve the surface area and to allow greater contact with thin plates extending from the pipes. The structure of the coil or pipe system within the water tank is such as to facilitate heat exchange.

Thus, hot gas passing through the heat exchanger heats up water for use for other purposes. The gas is then returned to the delivery side of the compressor before passing to the condenser for cooling.

It has also been found that the apparatus can be efficiently operated without the need for a air temperature controller to control the temperature of the air entering the apparatus and flowing over the evaporator.

With reference to the apparatus shown in FIGS. 1–3, the apparatus can efficiently produce water from the air, via ice formation on the evaporator, without the presence of the air temperature controller (i.e. air heater 5, cold air duct 18), if the volume of the air entering the apparatus and passing over the frosting area of the evaporator is controlled. The frosting area of the evaporator being the surface of the evaporator on which the water in the air freezes. All other integers of the apparatus can be as described for the apparatus described with reference to FIGS. 1–3.

If the temperature of the air entering the apparatus is cool (say less than about 10° C.) the volume of air passing over the evaporator's frosting surface can be high, if the air temperature is high (say above about 25° C.) the volume of air should be low. This is essentially a function of the energy and time required to freeze the water out of the air. The relationship of our volume and air temperature will be well known to a skilled person.

The process will also be dependent on the efficiency of the evaporator to freeze the water in the air. This will be a function of compressor (i.e. 21 in FIG. 1) size compared with evaporator (i.e. 7 in FIG. 1) size as will be known in the art. In practice, the efficiency of the evaporator in any given apparatus unit will be constant and the variable factors to efficiently produce ice can be controlled by known technology which will preferably involve a central processing unit or the like. Again freezing efficiency will be a factor known to a skilled person.

An alternative, though less preferred option, is to alter the area of the frosting surface of the evaporator while maintaining the air flow volume across the evaporator constant. This could be achieved by stopping the refrigerant flow to parts of the evaporator or by simply removing or covering portions of the evaporator. These should not be seen to be limiting and alternatives which will be apparent to a skilled person may also be used.

FIG. 4, shows a preferred, and alternative, apparatus which incorporates the volume of air control option and excludes the air temperature controller device for controlling the air temperature entering the apparatus.

In the apparatus shown in FIG. 4 a TX valve 153 is used instead of the capillary tubes as shown in FIG. 1. A TX valve is a valve which will be known to a skilled person and alternatives to such a valve may also be used.

FIG. 4 shows an apparatus 100 having an evaporator 110, a fan 120, and a compressor unit 130. The compressor unit includes coils 131 which surround the compressor itself (not shown in FIG. 4 as the compressor itself is obscured by the coils 131).

The refrigerant from the compressor unit moves to the evaporator 110 via feed 140.

The apparatus 100 is compartmentalised into two compartments by wall 150. The compartments are a high pressure compartment 151 and a low pressure compartment 152. The compartments should preferably be sealed air tight from each other however the apparatus will operate, though not so efficiently, if the seal is not air tight. The movement of the refrigerant via feed 140 from the high pressure area 151 to the low pressure area 152 causes a drop in temperature of the refrigerant to be used to cool the evaporator 110.

The air tight seal for the apparatus shown in FIG. 4 can be provided by a cover (not shown) which fits over the apparatus 100 and which sealingly engages with the ends of the wall 150 in a preferably releasable manner.

The apparatus 100 also includes a single fan 120 positioned between the evaporator 110 and the condenser unit 130. The fan 120 could be positioned elsewhere in the apparatus 100 (eg. above the condenser unit 130) provided an air flow over the evaporator 110 and through the condenser unit 130 is maintained. The positioning of the fan as shown in FIG. 4 is a preferred alternative. As will be apparent, and with reference to FIG. 1 for example, a two fan option could also be used, however this will result in a larger sized apparatus, which may, or may not, be preferred depending on circumstance. Should a two fan option be used, the compartmentalisation of the apparatus may not be required.

The ice formed on the evaporator 110 can be defrosted as discussed for FIGS. 2 and 3 (the disclosure with regard to this is repeated) and the water formed will be collected in a reservoir at the base of the apparatus and pumped via filter 160 to tap 161.

The apparatus 100 can also, preferably, include a temperature sensor (not shown) to determine the air temperature outside the apparatus 100 to maximise the efficiency of the process by allowing a central processing unit to adjust the fan speed in response to the temperature. In practice, however, it is likely that the apparatus 100 will be set up in a standard manner for standard temperature conditions in the environment of use.

In essence, the process of extracting water from the air via ice formation has been found to depend on a range of variables. The temperature of the air entering the apparatus, the volume of air passing over the surface area of the evaporator, and the efficiency of the evaporator.

As shown with reference to FIG. 1, if the temperature of the air entering the apparatus is controlled and the efficiency of the evaporator is known, then the volume of the air across the evaporator can be standardised.

As discussed with reference to FIG. 4, and to FIGS. 1–3 without the temperature controller, if the temperature of air entering the apparatus is not controlled, but the evaporator efficiency is known for any given apparatus unit, the freezing of the water from the air can be efficiently achieved by varying the volume of the air across the surface area of the evaporator. Removal of the air temperature control system from the apparatus shown in FIG. 1 allows the formation of smaller apparatus units, as shown for example in FIG. 4.

The apparatus of the invention may be employed for removing sufficient quantities of water from the air for general household use, as well as enabling the heating of this water of desired. Standard heating techniques as known in the art could be used.

As will be readily apparent to a person skilled in this particular art, the apparatus described utilises a number of components which may be of many different forms. It is not intended that the invention be restricted to particular components, as have been described, and any suitable alternative components may be used. A number of ranges have been referred to herein. Any individual, or combination, of the numbers falling within those ranges is intended to be included within the invention scope.

The foregoing describes the invention including a preferred form thereof. Alterations and modifications which will be obvious to a skilled person are intended to be included within the spirit and scope of the invention, as defined in the appended claims.

What is claimed is:

1. An apparatus for the production of water from the surrounding air, the apparatus including:

a) an air intake device adapted to move air into the apparatus;

b) an evaporator adapted to freeze the water contained in the air issuing from the air intake device; and c) defrosting means adapted to defrost the water frozen by the evaporator;

and wherein the volume of air passing over the frosting surface of the evaporator is controlled by either the air intake device or the evaporator.

2. The apparatus according to claim 1 wherein the air intake device is adapted to move a variable volume of air over the evaporator and the evaporator is of constant frosting area.

3. The apparatus according to claim 1 wherein the air intake device is adapted to move a constant volume of air over the evaporator and the evaporator is adapted to have a variable frosting area.

4. The apparatus according to claim 1 further including an air filter situated to filter the air moving into apparatus.

5. The apparatus according to claim 1 wherein the defrosting means includes a defrost sensor to detect when a predetermined amount of ice or frost has formed on the evaporator.

6. The apparatus according to claim 1 wherein the evaporator and/or the condenser includes one or more helically corrugated conduits.

7. The apparatus according to claim 1 wherein the evaporator is cooled using a compressor and condenser system.

8. The apparatus according to claim 7 wherein the compressor and condenser system includes a further independently controllable air intake device.

9. The apparatus according to claim 1 wherein the evaporator is cooled using a compressor and condenser system including a compressor, a condenser, and a plurality of capillary tubes, wherein the evaporator includes a plurality of interconnected coils and the capillary tubes feed directly into the evaporator coils, and wherein the compressor provides a gaseous refrigerant under pressure into the condenser, the cooled refrigerant exiting the condenser as a liquid under pressure and being directed to the capillary tubes via a high pressure feed, the capillary tubes then passing the refrigerant in a gaseous form into the evaporator from which the refrigerant exits as a gas under low pressure and returns via a low pressure feed to the compressor, and wherein the system is a closed system.

10. An apparatus for the production of water from the surrounding air wherein the apparatus includes:

a) an air intake device adapted to move air into the apparatus;

b) an air temperature controller which controls the temperature of the air entering the apparatus;

c) an evaporator adapted to freeze water contained in the air issuing from the temperature controller; and d) a defroster, adapted to defrost the water frozen by the evaporator.

11. The apparatus according to claim 10 wherein the air temperature controller includes a first air temperature sensor situated at, or adjacent to, the entrance of the air intake device; and an air heater/cooler positioned between the first air temperature sensor, and the evaporator.

12. The apparatus according to claim 10 wherein the air temperature controller includes a second air temperature sensor positioned between the air heater/cooler and the evaporator.

13. The apparatus according to claim 10 wherein the defroster, the air temperature controller, the air intake device and the temperature of the evaporator are controlled via a single central processing unit.

14. The apparatus according to claim 10 wherein the evaporator is cooled using a compressor and condenser system including a further independently controllable air intake device.

* * * * *